US007036155B2

(12) United States Patent
Rugg

(10) Patent No.: US 7,036,155 B2
(45) Date of Patent: May 2, 2006

(54) HAT ASSEMBLY COMPRISING A CARRYING MEMBER HAVING A SELECTED SHAPE AND FOLDABLE HAT

(76) Inventor: Douglas Rugg, 5393 Santa Ana Ave., Costa Mesa, CA (US) 92627

( * ) Notice: Subject to any disclaimer, the term of this patent is extended or adjusted under 35 U.S.C. 154(b) by 165 days.

(21) Appl. No.: 10/692,208

(22) Filed: Oct. 22, 2003

(65) Prior Publication Data

US 2004/0083535 A1 May 6, 2004

Related U.S. Application Data

(60) Provisional application No. 60/421,466, filed on Oct. 25, 2002.

(51) Int. Cl.
*A42B 1/00* (2006.01)

(52) U.S. Cl. ..... 2/171.03; 2/209.11; 2/209.12

(58) Field of Classification Search ..... 2/172, 2/171.03, 175.1, 175.3, 175.4, 209.11, 209.12, 2/209.13
See application file for complete search history.

(56) References Cited

U.S. PATENT DOCUMENTS 4,165,542 A * 8/1979 McLaughlin ..... 2/209.13
6,256,794 B1 7/2001 Erickson ..... 2/209.11
6,317,892 B1 11/2001 Galigani ..... 2/209.11
2005/0076420 A1 * 4/2005 Hafif ..... 2/209.13

* cited by examiner

*Primary Examiner*—John J. Calvert
*Assistant Examiner*—Andrew W. Sutton
(74) *Attorney, Agent, or Firm*—Daniel J. Meaney, Jr.

(57) ABSTRACT

A hat assembly including a hat that is selectively disposed in either a collapsed position or an expanded position is shown. The hat comprises a head engaging portion including a side wall, a crown and a brim. The brim has a substantially annular configuration at least partially defined by a central opening and an outer periphery having a continuous, substantially circular configuration. The side wall have an inner end being of substantially equal dimension as a circumference of the central opening and the inner end is secured continuously to the circumference along mutual lengths thereof. Breathing holes may be formed in the side walls to prevent sweating or perspiration on the head of a wearer. The hat has an expanded position and a collapsed position wherein the crown is structured to be folded into and out of the interior of the hat. A method of selectively disposing a hat in a hat assembly in either a collapsed position or an expanded position is also shown.

57 Claims, 4 Drawing Sheets

HAT ASSEMBLY COMPRISING A CARRYING MEMBER HAVING A SELECTED SHAPE AND FOLDABLE HAT

CROSS-REFERENCES TO RELATED APPLICATIONS

This Application claims the benefit, under Title 35, United States Code §119(e), of U.S. Provisional Patent Application Serial No.: 60/421,466 filed Oct. 25, 2002.

STATEMENT REGARDING FEDERALLY SPONSORED RESEARCH OR DEVELOPMENT

Not Applicable

REFERENCE TO A "MICROFICHE APPENDIX" (SEE 37 CFR 1.96)

Not Applicable

BACKGROUND OF THE INVENTION

1. Field of the Invention

The present invention relates to a hat assembly having a predetermined shape, e.g., a basketball, a soccer ball, a tire, a football or the like, that is structured to store in a carrying member a hat that is selectively positionable between a collapsed, stored position in the carrying member, and an expanded position designed for wearing. In the expanded position, the hat is preferably structured to include an enlarged brim that extends sufficiently outward from the head of the wearer so as to offer protection against the rays of the sun or rain.

2. Description of the Related Art

The wearing of hats by the population generally has been popular for many years. This popularity has lead to a wide variety of hats being available in numerous sizes and configurations which heretofore are primarily dictated by style preferences. In addition to being dictated by style preferences, certain hat designs are created to be primarily functional to the extent that certain hats are specifically fabricated for specific purposes such as warmth, protection from the rays of the sun, rain and the like.

Hats are available in a wide variety of designs. Typically, hats designed primarily for the men's market are not focused in terms of making a fashion statement. Thus, hats designed primarily for the men's market are usually more visible in that they are often more casual, as evidenced by baseball caps, cowboy hats, and other sporting apparel.

Hats designed primarily for the women's market are focused in terms of making a fashion statement. Thus, hats designed primarily for the women's market are usually stylish and have decorative components or detailed and have features which attract attention, as evidenced by wide annular shaped brim straw hats, sun hats having a large front brims and other stylish feature.

Recently, the distinction between hats designed primarily for the men's market or for the women's market is becoming blurred in that women are now wearing hats designed primarily for the men's market, such as baseball caps, cowboy hats and the like.

One problem or disadvantage associated with the design of various hat structures, regardless of whether they are intended for the men's market or women market, is the storage of the hat in a carrying member without folding or otherwise damaging the hat itself. For example, with respect to many fashionable hats, including some cowboy hats, storage often requires the use of relatively large, bulky "hat boxes" or other storage containers that take up a great deal of room and which are impractical for carrying the hat to a function, such as a sporting function. As such, it is difficult to transport hats stored in such carrying or storage cases.

Thus, the carrying of a hat, when it is not being worn, is generally considered to be somewhat bothersome, particularly with hats of larger sizes and/or of configurations designed to shade a wearer from the rays of the sun or provide protection from rain or the like.

The prior art discloses some solutions to overcome the problem of how to store a hat without damaging it.

For example, with respect to baseball caps, it is known to provide a pole-like structure with a plurality of clips disposed thereon, each of which is structured to receive the bill of the cap therein so as to permit easy storage and display of several baseball caps.

Foldable hats have been developed, one of which provides a rigid skeletal frame comprised of a number of "ribs," typically made of wood and carrying a common fabric covering, which ribs are all connected at one end at a central pivot point, about which individual ribs of the frame can be "fanned" to cause the hat to assume a wearable orientation or a folded orientation, as desired.

In addition, foldable hats have been developed which are formed of a cloth material and which utilize a flexible hoop structured to act as a supporting frame for the material defining the hat, which hoop may be manipulated to cause the hat to assume what may be considered a collapsed position for storage.

U.S. Pat. No. 6,317,892 discloses a foldable hat with a storage pocket wherein the hat is fabricated from a supple and foldable material and comprises a reversible pocket made in the hat, into which the hat can be folded and stored when not in use. The hats are styled in the form of a golf hat, e.g. FIG. 11. Or baseball hat, e.g., FIG. 16, and which are hats of a style typically designed for the men's market.

U.S. Pat. No. 6,256,794 discloses a hat assembly capable of being repeatedly, easily and selectively oriented either in a compact, collapsed position for convenient storage and transport, or in an outwardly expanded position for wearing. The hat assembly includes a head engaging portion which at least partially encloses a portion of the head of a wearer, and an outwardly extending brim, both preferably made of a soft, flexible cloth material. The brim is structured to extend outwardly a significant distance from the head of the wearer so as to offer some protection to the wearer's face, neck and shoulders from the sun, by maintaining these areas in a shaded position. The hat assembly also includes a shaping frame in the form of a continuous, closed loop of flexible material secured to an outer periphery of the brim. In the expanded position, the hat assembly is defined by the shaping frame assuming a single substantially circular configuration and exerting a radially directed tensioning force on the brim so as to maintain it in a substantially planar orientation in surrounding relation to the wearer's head. The collapsed position is defined by twisting or other manipulation of the shaping frame to orient and dispose the shaping frame in a plurality of attached, substantially concentrically oriented loops with the material defining the brim and the head engaging portion disposed in folded over relation about the loops. The hats are styled in the form of a annular shaped, wide brimmed sun hat, e.g. FIGS. 1, 11 and 12, and which are hats of a style typically designed for the women's market.

As some of the more stylish hats often incorporate wide brims as well, a problem associated with known collapsible hat structures is the inability to satisfy certain styling demands and to provide a carrying case having a predetermined shaped representing a known article, such as for example, a basketball shape or car tire shape.

BRIEF SUMMARY OF THE INVENTION

None of the prior art discloses, teaches, suggests or anticipates a hat assembly having a carrying member for enclosing a foldable or collapsible hat which include a head engaging portion and a substantially wide brim that extends outwardly a significant distance from the face and head of the wearer.

The hat can be of a design or style wherein the overall design and configuration of the hat meets certain styling requirements and further, wherein the dimensions of the various portions of the hat are sufficient to provide adequate shade to the head and other portions of the wearer's body. The hat assembly permits the hat to be easily stored in a collapsed position and making it easy to carry the same from place to place.

Accordingly, one advantage of the present invention is that the hat assembly fills a need in the art and market for an improved hat assembly having a carrying member having a predetermined shape of a known article for enclosing and storing a hat which is selectively positionable between a collapsed position for storage and an expanded position for wearing.

One advantage of the present invention is to provide a hat assembly for storing and carrying a hat which is structured to be readily positioned into either an expanded position for wearing or a collapsed position for storage, as desired, and which can be conveniently carried or otherwise transported when in the collapsed position.

Another advantage of the present invention is to provide a hat assembly having a hat which includes a brim portion that extends outwardly from the head of a wearer by a distance which is sufficient to provide some protection to the face and upper body portion of the wearer from the sun's rays, when the hat is in the expanded position and that will not interfere with the hat's assuming of the collapsed position.

Another advantage of the present invention to provide a hat assembly having a collapsible hat which is designed and configured to satisfy current styling objectives so as to be readily adaptable to a variety of wardrobe combinations, thereby rendering the overall design of the hat assembly more versatile.

Another advantage of the present invention is to provide a collapsible hat assembly which includes at least one attachment member having an elongated configuration extendable outwardly from the fastening member and being structured for carrying the hat assembly when the hat is disposed within the carrying member and the fastening member is in its closed position.

Another advantage of the present invention is to provide a hat assembly having a hat which is retained in the carrying member when in its collapsed position, and to facilitate carrying thereof on the wearer's body by use of an attachment member, if desired, when the hat is not being worn.

An advantage of the hat assembly according to the present invention is that the carrying member is structured to have sufficient flexibility as well as structural integrity to allow repeated, selective positioning of the hat between a collapsed position for storage and an expanded position for wearing by exerting a minimal amount of force thereon to orient the hat between the two positions.

Another advantage of the present invention is that the carrying member of the hat assembly can be formed into a predetermined shaped representing a known article, such as for example, a basketball shape or car tire shape.

Another advantage of the present invention is that the carrying case can be formed in a predetermined shape and comprise a pair of spaced, substantially planar outer layers each having an outer periphery defining an elongated, flexible fastening member extending substantially along the entire length of each of the outer layers. The carrying member is structured for storing between the outer layers a hat in a collapsed position. The fastening member is formed to have a closed position and an open position wherein the fastening member when in said closed position joins the outer layers to store the hat in the collapsed position and when in open position enables a stored collapsed hat to be removed therefrom and expanded into an expanded position.

Another advantage of the present invention is that the hat stored in the carrier member includes a head engaging portion including a side wall, a crown and a brim having a substantially annular configuration at least partially defined by a central opening and an outer periphery having a continuous, substantially circular configuration.

Another advantage of the present invention is that the expanded position of the hat is defined by the crown of the hat being oriented in a continuous, circular configuration and wherein the brim assumes a substantially planar configuration oriented substantially coplanar to the crown and wherein that portion of the crown being operatively connected to the inner surface of one of said outer layers is folded so as to be located interior to said side wall.

Another advantage of the present invention is that the collapsed position of the hat is defined by that portion of the crown being operatively connected to the inner surface of one of the outer layers being positioned exterior to said side wall and oriented with the brim and head engaging portion is disposed in a folded over relation to one another about and between said outer layers.

The present invention relates to a novel, new and unique hat assembly including a hat that is selectively disposed in either a collapsed position or an expanded position so that it can be worn, as desired. The hat assembly comprises a carrying member formed in a predetermined shape and having a pair of spaced, substantially planar outer layers each having an outer periphery defining an elongated, flexible fastening member extending substantially along the entire length of each of the outer layers. The carrying member is structured for storing between the outer layers the hat in a collapsed position. The fastening member are formed to have a closed position and an open position the fastening member when in said closed position joins the outer layers to store the hat in its collapsed position and when in open position enables a stored collapsed hat to be removed therefrom and expanded into an expanded position for wearing if desired. The hat comprises a head engaging portion including a side wall and a crown secured to an outer end of the side wall. The crown is operatively connected to an inner surface of one of the outer layers. The hat includes a brim having a substantially annular configuration at least partially defined by a central opening and an outer periphery having a continuous, substantially circular configuration. The said side wall has an inner end being of substantially equal dimension as a circumference of the central opening. The inner end is secured continuously to the circumference along mutual lengths thereof.

The expanded position of the hat is defined by the crown of the hat being oriented in a continuous, circular configuration and wherein the brim assumes a substantially planar configuration oriented substantially coplanar to the crown and wherein that portion of the crown, which is operatively connected to the inner surface of one of the outer layers, is folded so as to be located interior to the side wall.

The collapsed position of the hat is defined by that portion of the crown which is operatively connected to the inner surface of one of said outer layers positioned exterior to the side wall and oriented with the brim and head engaging portion being disposed in folded over relation to one another about and between the outer layers.

The collapsible hat of the present invention includes a head engaging portion dimensioned and configured to be positioned on the wearer's head and an outwardly extending brim.

The outwardly extending brim is preferably, but not necessarily, secured to the head engaging portion and extends outwardly therefrom a sufficient distance so that when in the expanded position, the brim will provide some protection from the sun's rays to the wearer's head and neck region. Also in a preferred embodiment, the shaping frame is secured to an outer peripheral region of the outwardly extending brim and is structured and disposed to cause the brim of the hat to assume a substantially planar configuration when in its expanded, operative position.

In the collapsed position, the overall dimension, configuration and shape of the carrying member forming part of the hat assembly is such as to allow it to be receive and store the hat in its collapsed position when the hat is significantly smaller than when the hat is in an expanded position for wearing. The pliability of the breathable, soft, pliable textile material from which the head engaging portion and the outwardly extending brim are formed are such as to allow these structures to be folded upon themselves between into a substantially co-planar position without creasing or causing fold lines to be formed therein.

Another advantage of the present invention is that the hat assembly may at least one attachment member having an elongated configuration extendable outwardly from the fastening member and which is structured for carrying the hat assembly when the hat is disposed within the carrying member and the fastening member is in its closed position.

Another advantage of the present invention is that as an additional alternative, a small, decorative band or decorative-like structure may be mounted on the exterior of the hat adjacent to the head engaging portion or on the brim and when so positioned, the aforementioned decorative member or members may be considered a part of the hat.

BRIEF DESCRIPTION OF THE DRAWING

The present invention will become more fully understood from the following detailed description of a preferred but non-limiting embodiment thereof, described in connection with the accompanying drawings, wherein.

Like reference numerals refer to like parts throughout the several views of the drawings.

DETAILED DESCRIPTION OF THE INVENTION

Figure 1:
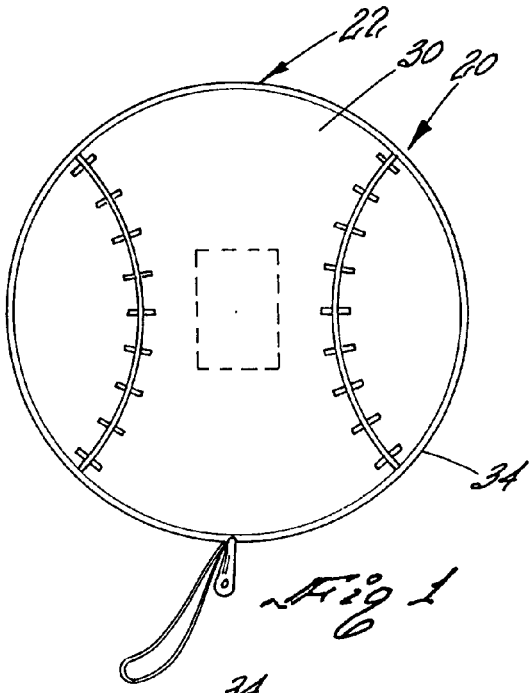
FIG. 1 is a front direct view of a hat assembly having a carrier member in the shape of an article which is a baseball; having a pair of spaced, substantially planar outer layers each having an outer periphery defining an elongated, flexible fastening member wherein the fastening member in a closed position.
Figure 2:
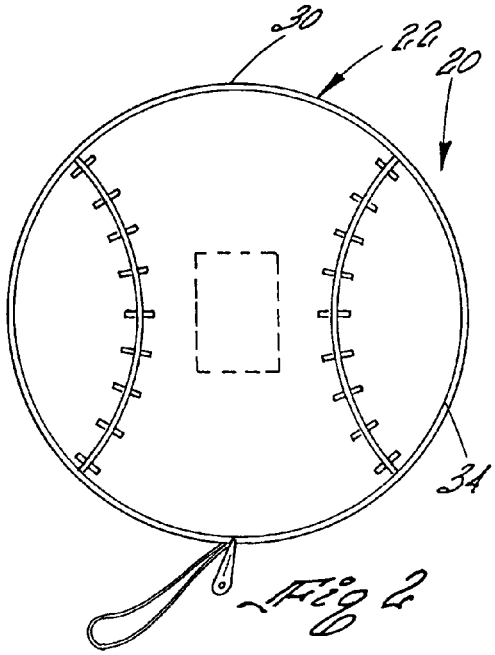
FIG. 2 is a back direct view of a hat assembly having a carrier member in the shape of a baseball shown in FIG. 1.
Figure 4:
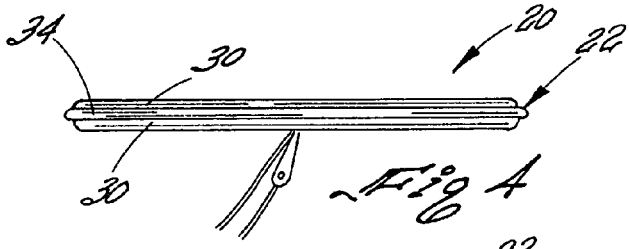
FIG. 4 is a top elevational view of the hat assembly of FIG. 1.
Figure 7:
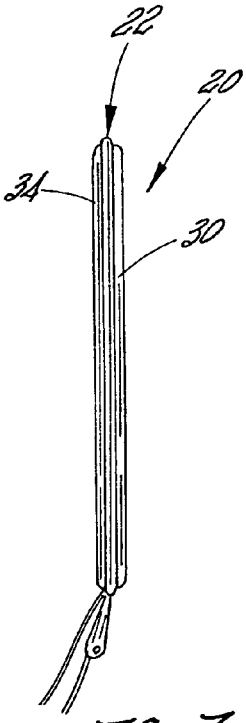
FIG. 7 is a left side elevational view of the hat assembly of FIG. 1.
Figure 3:
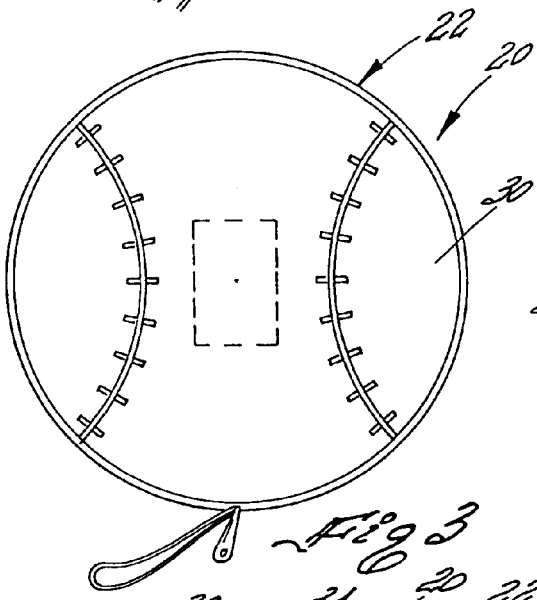
FIG. 3 is a front elevational view of the hat assembly of FIG. 1.

As shown in FIGS. 1 through 9, the present invention is primarily directed towards a hat assembly, generally indicated by arrow numeral 20, which comprises a carrying member shown by arrow 22 for hat that can be selectively disposed in either a collapsed position or an expanded position. FIGS. 9 through 14 show the details of the hat designated generally by arrow 26.

The carrying member 22, illustrated in FIGS. 1 through 14, is formed in a selected shape of an article, such as a round ball shown in FIGS. 1 through 8 and FIGS. 17 through 21. The round balls can be of the articles such as a basketball, baseball, soccer ball tennis ball or the like.

The carrying member includes a pair of spaced, substantially planar outer layers 30 each having an outer periphery defining an elongated, flexible fastening member 34 extending substantially along the entire length thereof. The carrying member 22 is structured for storing between the outer layers 30 a hat 26 in a collapsed position.

The fastening member 34 is formed to have a closed position and an open position wherein the fastening member 34 when in said closed position joins the outer layers 30 to store the hat 26 in the collapsed position and when in open position enables a stored collapsed hat 26 to be removed therefrom and expanded into an expanded position.

Referring now to FIGS. 9 through 14, the hat 26 comprises a head engaging portion shown generally by arrow 38 including a side wall 40 and a crown 42 secured to an outer end of the side wall 40. The crown is operatively connected to an inner surface of one of said outer layers 30.

The hat 26 includes a brim 46 having a substantially annular configuration at least partially defined by a central opening and an outer periphery having a continuous, substantially circular configuration. The side wall 40 has an inner end being of substantially equal dimension as a circumference of the central opening, the inner end being secured continuously to the circumference along mutual lengths thereof as illustrated in greater detail in FIGS. 12 through 14.

Figure 13:
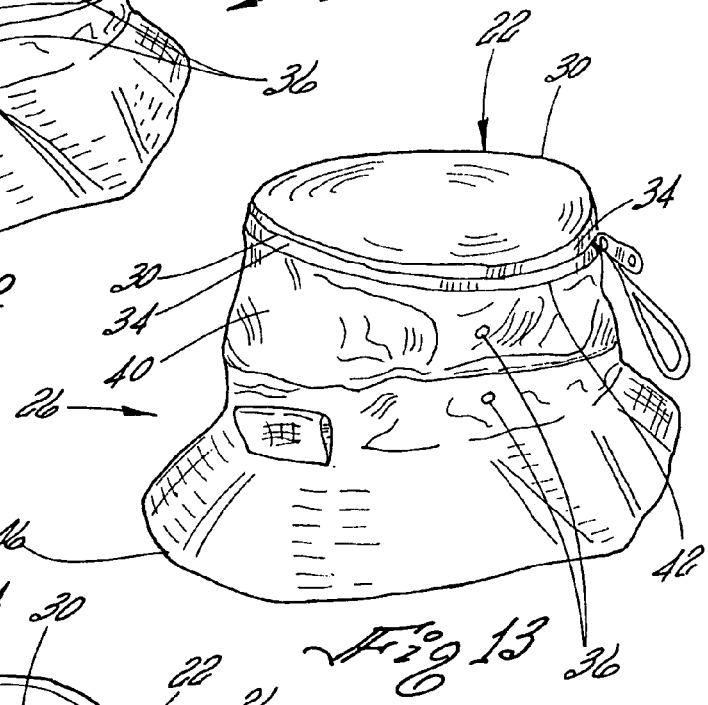
FIG. 13 is an illustration of a hat assembly shown in FIG. 12 with the fastening member moved from its open position to its closed position positioning the carrier member coplanar with the crown.
Figure 14:
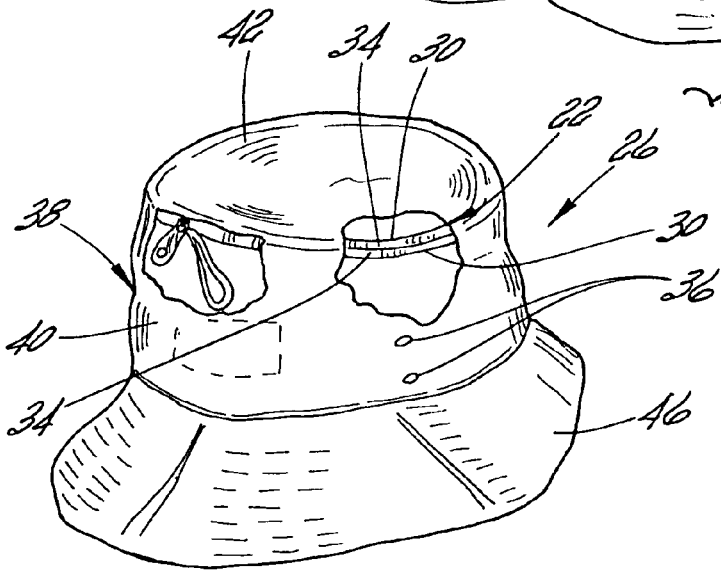
FIG. 14 is an illustration of a hat assembly shown in FIG. 13 wherein the crown having the carrying member operatively connected thereto has been moved into the interior of the side wall by inverting and reversing the hat in its expanded position so as to locate the carrier member interior to the hat in its expanded position.

As is illustrated in FIG. 14, the expanded position of the hat is defined by the crown 42 of the hat 26 being oriented in a planar configuration and wherein the brim 46 assumes a substantially planar configuration oriented substantially coplanar to the crown 42. That portion of the crown 42 being operatively connected to the inner surface, clearly shown in FIGS. 12 and 13, of one of the outer layers 30 is folded or the hat 26 reversed, as shown in FIG. 14, so as to move or locate the carrying member, with the fastening member back in its closed position, interior to the side wall 40.

Figure 9:
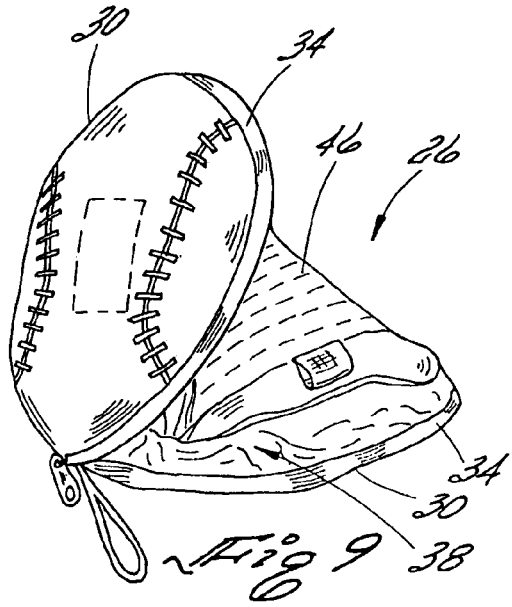
FIG. 9 is an illustration of a hat assembly having a carrier member in the shape of an article which is a baseball as shown in FIG. 8 with the fastening member in an open position and one of the pair of outer layers disposed to show a collapsed hat located between the pair of outer layers.
Figure 10:
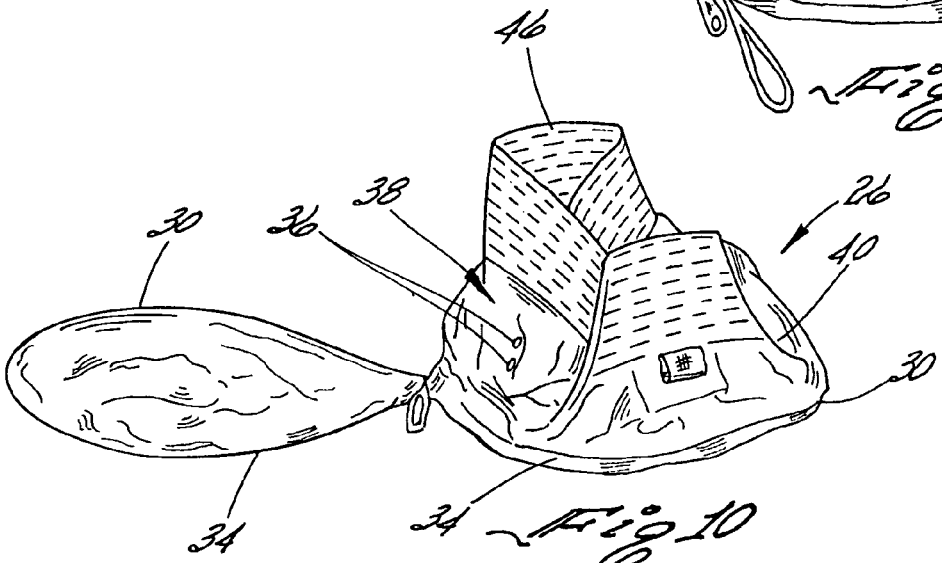
FIG. 10 is an illustration of a hat assembly having a carrier member in the shape of an article which is a baseball as shown in FIG. 9 with the fastening member in an open position and one of the pair of outer layers further disposed to show the collapsed hat located between the pair of outer layers in a partially expanded position.
Figure 11:
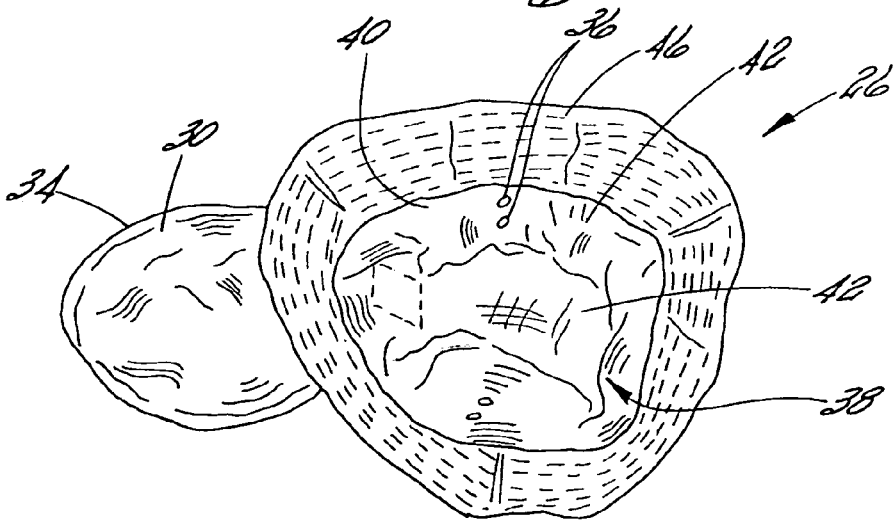
FIG. 11 is an illustration of a hat assembly having a carrier member in the shape of an article which is a baseball as shown in FIG. 10 with the fastening member in an open position and one of the pair of outer layers further disposed to show the collapsed hat located between the pair of outer layers in a substantially expanded position.
Figure 12:
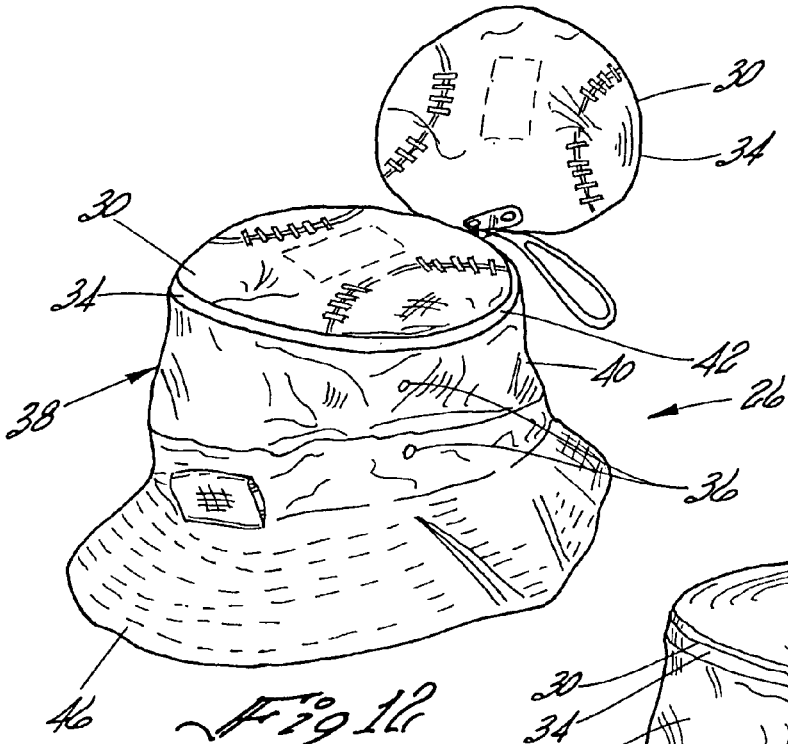
FIG. 12 is an illustration of a hat assembly having a carrier member in the shape of an article which is a baseball as shown in FIG. 11 with the fastening member in an open position and one of the pair of outer layers disposed relative to the other of the pair of outer layers prior to the fastening member being moved from its open position to its closed position.

The collapsed position of the hat 26 is defined by that portion of said crown 42 being operatively connected to the inner surface of one of the outer layers 30 which is positioned exterior to the side wall 40 and oriented with the brim 46 and head engaging portion 38 being disposed in folded over relation to one another about and between the outer layers 30 as illustrated by FIG. 9.

Preferably, both the head engaging portion 38 and the outwardly extending brim 42 are formed of a breathable, soft, pliable textile material to facilitate an exchange of air from the interior of the hat to the exterior of the hat, or breathing, so prevent the build-up of sweat or perspiration on the head of a wearer. For example, if the entire hat assembly 20 was fabricated of polyvinylchloride, this results in an unacceptable hat 26 in that polyvinylchloride prevents breathing and results in the build-up of sweat or perspiration on the head of a wearer, which is undesirable.

On the other hand, it is envisioned that the hat assembly 20 could have the carrying member 22 formed of a first material and the hat 26 formed of a second different material. The first material of the hat assembly 20 could be formed of a water resistant material and the second material could be formed of a breathable, soft, pliable textile material. In this instance, the first material of the hat assembly could be formed of polyvinylchloride since the hat 26 being formed of the breathable, soft, pliable textile material would facilitate breathing so at to prevent the build-up of sweat or perspiration on the head of a wearer.

In order to insure that the hat 26 will be breathable to prevent the build-up of sweat or perspiration on the head of a wearer, the sidewall 40 of the hat 26 can be formed with breathing holes shown as 36 on FIGS. 10 through 14.

Thus, if the entire hat assembly 20 including the hat 26 is formed of a non-breathable material, the addition of the breathing holes 36 overcomes the objection and problems associated with using a non-breathable material.

Thus, the hat assembly could be fabricated as follows:

(a) Hat assembly 20 fabricated all of one material which is non-breathing material with breathing holes 36 in the hat;

(b) Hat assembly 20 fabricated all of one material which is a breathable material and which may, optionally include breathing holes 36; and (c) Hat assembly 20 fabricated with the carrying member formed or fabricated of a non-breathing material and the hat 26 being formed or fabricated of a breathable material which may, optionally, include breathing holes 36.

The breathable, soft, pliable textile material could be formed of textile material having at least 50% cotton fiber content. In the alternative, the breathable, soft, pliable material used for the hat assembly could be formed of textile material comprising a blend of cotton fiber textile material and material made from man-made fibers wherein the textile material has in the order of at least 50% cotton fiber content to maintain breathability of the textile material.

The man-made fibers could be any one of the known man-made fibers used in or as textile material for the apparel, clothing and accessory industry including without limitation, man-made fibers are made from at least one of acrylic, polypropylene and polyester.

As shown particularly in FIGS. 13 and 14, the brim is disposed and structured to exert a radially directed tensioning force thereon when said hat is in said expanded position. The outwardly extending brim 46, the head engaging portion including the side wall and the crown are formed so as to be capable of being folded upon itself, ideally without creasing or otherwise creating fold lines therein.

With respect to the elongated, flexible fastening member 34 clearly illustrated in FIGS. 1 through 3 and 8, the elongated, flexible fastening member defined on the outer periphery of the substantially planar outer layers 30 and which extend substantially along the entire length thereof each includes a first fastening member and a cooperating second fastening member, one of which is located on the outer periphery of one of the pair of outer layers 30 and the other of which is located on the other of the pair of outer layers 30.

In the preferred embodiment, the fastening member is a zipper. However, it is envisioned that the fastening means can comprise another other fastening member known to persons skilled in the art including having the first fastening member and the second fastening member formed of mating elements defining a hook and loop fastener. Also, other known fastening members could be used such as a clip, buttons and the like.

Figure 15:
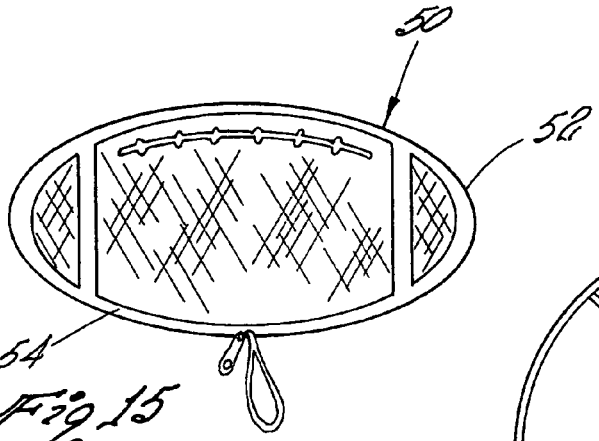
FIG. 15 is a top view of another embodiment of the present invention wherein the selected shape of the article defined by the carrying member is in the shape of a football.

FIG. 15, which is a top view of another embodiment of the present invention, discloses a hat assembly shown by arrow 50 wherein the selected shape of the article defined by the carrying member 52 is in the shape of football. The fastening member 54 is a zipper.

Figure 16:
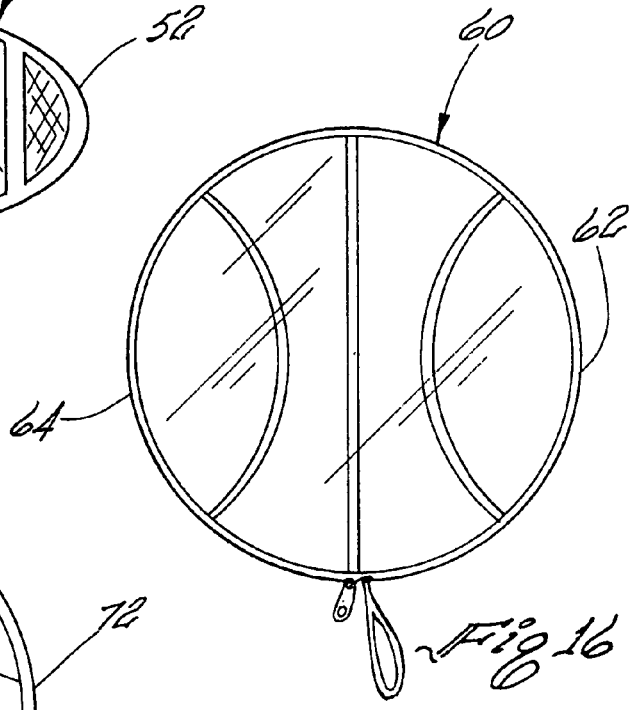
FIG. 16 is a top view of yet another embodiment of the present invention wherein the selected shape of the article defined by the carrying member is in the shape of a round ball as defined, for example, by a baseball.

FIG. 16, which is a yet top view of another embodiment of the present invention, discloses a hat assembly shown by arrow 60 wherein the selected shape of the article defined by the carrying member 62 is in the shape of a round ball, namely, a baseball. The fastening member 64 is a zipper.

Figure 17:
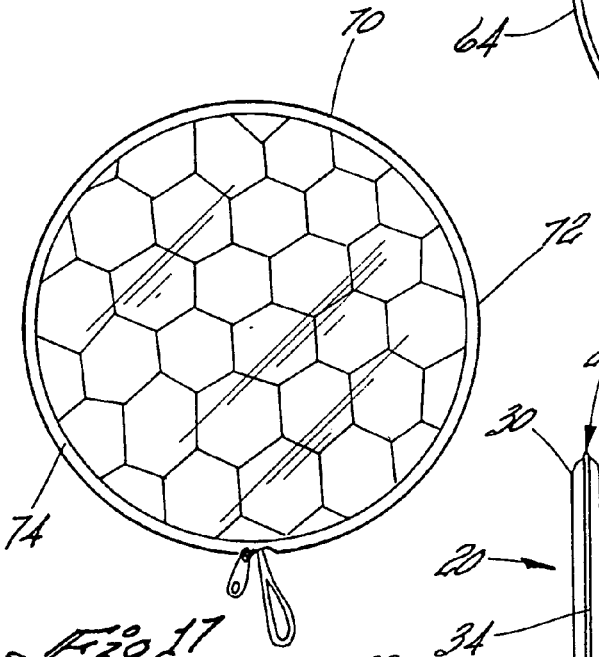
FIG. 17 is a top view of still yet another embodiment of the present invention wherein the selected shape of the article defined by the carrying member is in the shape of a round ball as defined, for example, by a soccer ball.

FIG. 17, which is a yet top view of another embodiment of the present invention, discloses a hat assembly shown by arrow 70 wherein the selected shape of the article defined by the carrying member 72 is in the shape of a round ball, namely, soccer ball. The fastening member 74 is a zipper.

Figure 6:
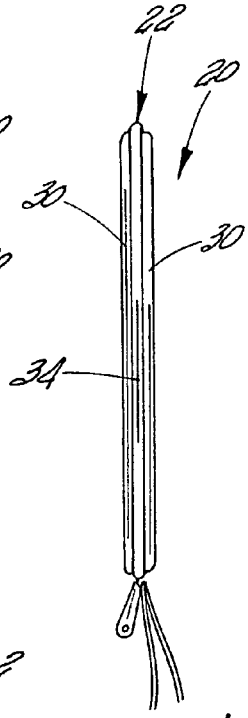
FIG. 6 is a right side elevational view of the hat assembly of FIG. 1.
Figure 5:
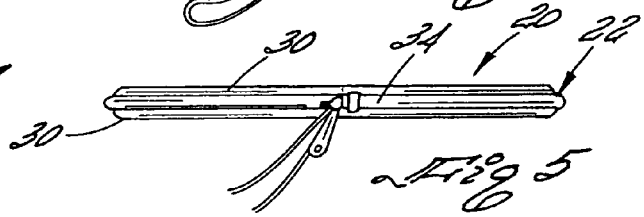
FIG. 5 is a bottom elevational view of the hat assembly of FIG. 1.
Figure 8:
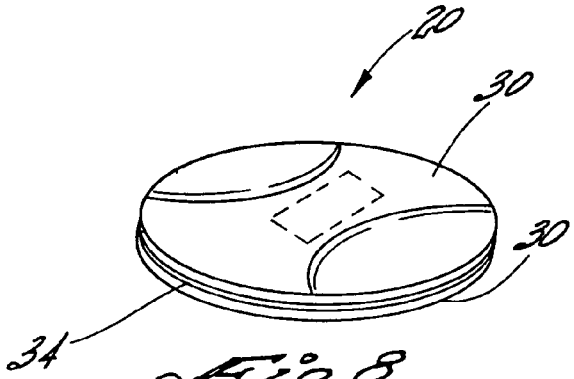
FIG. 8 is a front, bottom and left side perspective view of a hat assembly having a carrier member in the shape of an article which is a baseball as shown in FIG. 1 and having a pair of spaced, substantially planar outer layers each having an outer periphery defining an elongated, flexible fastening member wherein the fastening member in a closed position.
Figure 18:
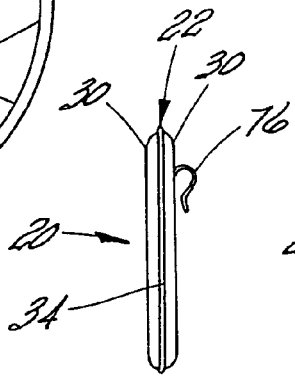
FIG. 18 is a right side elevational view of the carrying member illustrated in FIG. 6 having at least one attachment member in the form of a open spring loaded belt clip operatively connect to and extendable outwardly from said carrying member and being structured for carrying said hat assembly when said hat is disposed within said carrying member and said fastening member is in its closed position.

FIG. 18 is a right side elevational view of the carrying member 22 illustrated in FIG. 6 having at least one attachment member in the form of an open spring loaded belt clip 76 operatively connect to and extendable outwardly from the carrying member 22 and being structured for carrying the hat assembly when the hat is disposed within the carrying member 22 and the fastening member 34 is in its closed position.

Figure 19:
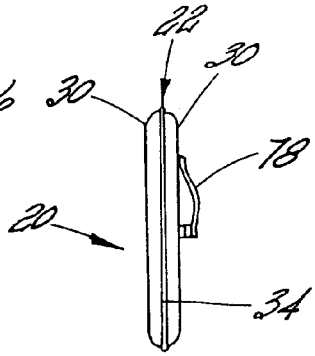
FIG. 19 is a right side elevational view of the carrying member illustrated in FIG. 6 having at least one attachment member in the form of a closed spring-loaded fastener clip member operatively connect to and extendable outwardly from said carrying member and being structured for carrying said hat assembly when said hat is disposed within said carrying member and said fastening member is in its closed position.

FIG. 19 is a right side elevational view of the carrying member 22 illustrated in FIG. 6 having at least one attachment member in the form of a closed spring-loaded fastener clip member 78 operatively connect to and extendable outwardly from said carrying member and being structured for carrying said hat assembly when said hat is disposed within said carrying member 22 and the fastening member 34 is in its closed position.

Figure 20:
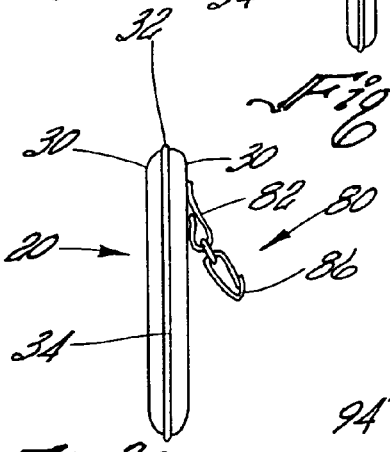
FIG. 20 is a right side elevational view of the carrying member illustrated in FIG. 6 having at least one attachment member in the form of a openable clasp member having a looped shaped connecting member for supporting a spring-loaded hooking member operatively connect to and extendable outwardly from said carrying member and being structured for carrying said hat assembly when said hat is disposed within said carrying member and said fastening member is in its closed position.

FIG. 20 is a right side elevational view of the carrying member 22 illustrated in FIG. 6 having at least one attachment member in the form of a openable clasp member shown generally by arrow 80 having a looped shaped connecting member 82 for supporting a spring-loaded hooking member 86 which are operatively connect to and extendable outwardly from the carrying member 22. The at least one attachment member in the form of a openable clasp member shown generally by arrow 80 is structured for carrying the hat assembly 20 when said hat is disposed within the carrying member 22 and said fastening member 34 is in its closed position.

Figure 21:
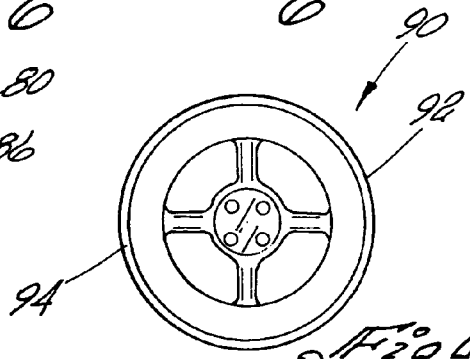
FIG. 21 is a top view of yet still another embodiment of the present invention wherein the selected shape of the article defined by the carrying member is in the shape a car wheel and tire assembly.

FIG. 21 is a top view of yet still another embodiment of a hat assembly 90 of the present invention wherein selected shape of the article defined by the carrying member 92 is in the shape a car wheel and tire assembly. The fastening member 94 is a zipper.

In an overview and referring to FIGS. 1 through 14, the hat assembly 22 includes a hat 26 that is selectively disposed in either a collapsed position or an expanded position. The hat assembly 26 comprises a hat 26 having a head engaging portion 38 including a side wall 40, a crown and a brim 46. The brim 46 has a substantially annular configuration at least partially defined by a central opening and an outer periphery having a continuous, substantially circular configuration.

The side wall 40 has an inner end being of substantially equal dimension as a circumference of the central opening defining the brim 46. The inner end is operatively attached or secured continuously to the circumference along mutual lengths thereof.

The hat 26, when in its expanded position, is defined by the crown 42 of the hat 26 being oriented in a planar configuration and the brim 46 assumes a substantially planar configuration oriented substantially coplanar to the crown 42 and a portion of the crown 42 is structured so as to be folded and located interior to the side wall 40 positioning the entire carrying member 22 interior to the hat 26.

The hat 26, when in its collapsed position, is defined by that portion of the crown 42 structured to be folded interior of to the side wall 40 is positioned exterior to the side wall 40 and oriented with the brim 46 and head engaging portion 38 being disposed in folded over relation to one another.

The carrying member 22 is formed into a selected shape and having a pair of spaced, substantially planar outer layers 30 each having an outer periphery defining an elongated, flexible fastening member 34 extending substantially along the entire length of each of said outer layers 30. One of the outer layers 30 has its inner surface operatively connected to a portion of the crown 42 at a selected location. The carrying member is structured for storing between the outer layers 30 a hat 26 in the hat's collapsed position. The fastening member 34 is formed to have a closed position and an opened position wherein the fastening member 34, when in said closed position, joins the outer layers 30 to store the hat 26 in the hat's collapsed position.

When the fastening member 34 is in its open position, the fastening member 34 is able to be opened, e.g. be unzipped, to define an opening dimensioned and configured to allow passage therethrough of the hat 26 in said collapsed position and expanded into an expanded position.

A method of selectively disposing a hat 26 in a hat assembly 20 in either a collapsed position or an expanded position, comprising the steps of: (a) forming a hat 26 comprising a head engaging portion 38 including a side wall 40 and a crown 42, a brim 46 having a substantially annular configuration at least partially defined by a central opening and an outer periphery having a continuous, substantially circular configuration wherein the side wall 40 has an inner end being of substantially equal dimension as a circumference of the central opening; the inner end being secured continuously to said circumference along mutual lengths thereof; (b) forming a carrying member 22 having a selected shape and having a pair of spaced, substantially planar outer layers 30 each having an outer periphery defining an elongated, flexible fastening member 24 extending substantially along the entire length of each of the outer layers 30 wherein one of the outer layers 30 has an inner surface operatively connected to a portion of the crown 42 at a selected location and the carrying member 22 is structured for storing between the outer layers 30 a hat 26 in said collapsed position, the fastening member 34 being formed to have a closed position and an opened position wherein the fastening member 34 when in said closed position joins the outer layers 30 to store the hat 26 in the collapsed position and when in open position enables a stored collapsed hat to be removed therefrom and expanded into an expanded position; and (c) at least one of folding and unfolding the hat 26 between an expanded position wherein the expanded position of the hat 26 is defined by the crown 42 of the hat 26 being oriented in a planar configuration and wherein the brim 46 assumes a substantially planar configuration oriented substantially coplanar to the crown 42 and wherein a portion of the crown 42 is structured so as to be folded and located interior to the side wall 40 and collapsed position wherein said collapsed position of the hat 26 is defined by that portion of the crown 42 structured to be folded interior of the side wall 40 being positioned exterior to the side wall 40 and oriented with the brim 46 and head engaging portion 38 being disposed in folded over relation to one another.

The above method may further comprising the step of: attaching to the carrying member 22 at least one attachment member extendable outwardly from therefrom and being structured for carrying the hat assembly 20 when the hat 26 is disposed within the carrying member 22 and the fastening member 34 is in its closed position.

In the method, the step of forming a hat may further comprise forming the hat of a breathable, soft, pliable textile material. Also in the method, the step of forming a carrying member further may comprises forming the carrying member of a breathable, soft, pliable textile material.

In the method, the step of forming a carrying member may further comprises forming the selected shape of the article defined by the carrying member in the shape of a round ball.

In the method, the step of forming a carrying member further may comprises forming the selected shape of the article defined by the carrying member in the shape of basketball.

In the method, the step of forming a carrying member further may comprises forming the selected shape of the article defined by the carrying member in the shape of a baseball.

In the method, the step of forming a carrying member further may comprises forming the selected shape of the article defined by the carrying member in the shape of a soccer ball.

In the method, the step of forming a carrying member further may comprises forming the selected shape of the article defined by the carrying member in the shape of football.

In the method, the step of forming a carrying member further may comprises forming the selected shape of the article defined by the carrying member in the shape of car wheel and tire assembly.

Since many modifications, variations and changes in detail can be made to the described preferred embodiment of the invention, it is intended that all matters in the foregoing description and shown in the accompanying drawings be interpreted as illustrative and not in a limiting sense. By way of example only, the hat assembly of the present invention might be structured to include a head engaging portion that does not fully engage the head of the wearer, and that variation would be within the spirit of the present invention. Thus, the scope of the invention should be determined by the appended claims and their legal equivalents.

What is claimed is:

1. A hat assembly including a hat that is selectively disposed in either a collapsed position or an expanded position, said hat assembly comprising:

a carrying member formed in a selected shape of an article and having a pair of spaced, substantially planar outer layers each having an outer periphery defining an elongated, flexible fastening member extending substantially along the entire length thereof, said carrying member being structured for storing between said outer layers a hat in a collapsed position, said fastening member being formed to have a closed position and an open position wherein said fastening member when in said closed position joins said outer layers to store said hat in said collapsed position and when in open position enables a stored collapsed hat to be removed therefrom and expanded into an expanded position; and wherein said hat comprises a head engaging portion including a side wall and a crown secured to an outer end of said side wall, said crown being operatively connected to an inner surface of one of said outer layers; and a brim having a substantially annular configuration at least partially defined by a central opening and an outer periphery having a continuous, substantially circular configuration;

said side wall having an inner end being of substantially equal dimension as a circumference of said central opening, said inner end being secured continuously to said circumference along mutual lengths thereof;

said expanded position of said hat being defined by said crown of said hat being oriented in a planar configuration and wherein said brim assumes a substantially planar configuration oriented substantially coplanar to said crown and wherein that portion of said crown being operatively connected to said inner surface of one of said outer layers is folded so as to be located interior to said side wall; and said collapsed position of said hat being defined by that portion of said crown being operatively connected to said inner surface of one of said outer layers being positioned exterior to said side wall and oriented with said brim and head engaging portion being disposed in folded over relation to one another about and between said outer layers.

2. The hat assembly of claim 1 further comprising at least one attachment member operatively connect to and extendable outwardly from said carrying member for carrying said hat assembly when said hat is disposed within said carrying member and said fastening member is in its closed position.

3. The hat assembly of claim 1 wherein said brim is disposed and structured to exert a radially directed tensioning force thereon when said hat is in said expanded position.

4. The hat assembly of claim 1 wherein the carrying member and hat are formed of a breathable, soft, pliable textile material.

5. The hat assembly of claim 4 wherein said breathable, soft, pliable textile material is formed of textile material having at least 50% cotton fiber content.

6. The hat assembly of claim 4 wherein said breathable, soft, pliable textile material is formed of textile material comprising a blend of cotton fiber material and material made from man-made fibers wherein the textile material has in the order of at least 50% cotton fiber content to maintain breathability of the textile material.

7. The hat assembly of claim 6 wherein said man-made fibers are made from at least one of acrylic, polypropylene and polyester.

8. The hat assembly of claim 1 wherein said carrying member and said hat are formed of the same material and the hat includes breathing holes.

9. The hat assembly of claim 1 wherein said carrying member is formed of a first material and said hat is formed of a second different material.

10. The hat assembly of claim 9 wherein said first material is formed of a water resistant material and said second material is formed of a breathable, soft, pliable textile material.

11. The hat assembly of 9 wherein said first material is polyvinylchloride.

12. The hat assembly of claim 9 wherein said breathable, soft, pliable textile material is formed of textile material having at least 50% cotton fiber content.

13. The hat assembly of claim 9 wherein said breathable, soft, pliable material is formed of textile material comprising a blend of cotton fiber textile material and said material made from man-made fibers wherein the textile material has in the order of at least 50% cotton fiber content to maintain breathability of the textile material.

14. The hat assembly of claim 13 wherein said man-made fibers are made from at least one of acrylic, polypropylene and polyester.

15. The hat assembly of claim 1 wherein said fastening member is a zipper.

16. The hat assembly of claim 1 wherein said fastening member includes a first fastening member and a cooperating second fastening member.

17. The hat assembly of claim 16 wherein said first fastening member and said second fastening member are mating elements defining a hook and loop fastener.

18. The hat assembly bag of claim 1 wherein the selected shape of the article defined by the carrying member is in the shape of a round ball.

19. The hat assembly bag of claim 1 wherein the selected shape of the article defined by the carrying member is in the shape of a basketball.

20. The hat assembly bag of claim 1 wherein the selected shape of the article defined by the carrying member is in the shape of a baseball.

21. The hat assembly bag of claim 1 wherein the selected shape of the article defined by the carrying member is in the shape of a soccer ball.

22. The hat assembly bag of claim 11 wherein the selected shape of the article defined by the carrying member is in the shape of a football.

23. The hat assembly bag of claim 16 wherein the selected shape of the article defined by the carrying member is in the shape of a car wheel and tire assembly.

24. A hat assembly including a hat that is selectively disposed in either a collapsed position or an expanded position, said hat assembly comprising a hat, said hat comprising a head engaging portion including a side wall and a crown;

a brim having a substantially annular configuration at least partially defined by a central opening and an outer periphery having a continuous, substantially circular configuration;

said side wall having an inner end being of substantially equal dimension as a circumference of said central opening; said inner end being secured continuously to said circumference along mutual lengths thereof;

said expanded position of said hat being defined by said crown of said hat being oriented in a planar configuration and wherein said brim assumes a substantially planar configuration oriented substantially coplanar to said crown and wherein a portion of said crown is structured so as to be folded and located interior to said side wall;

said collapsed position of said hat being defined by that portion of said crown structured to be folded interior of said side wall being positioned exterior to said side wall and oriented with said brim and head engaging portion being disposed in folded over relation to one another; and a carrying member formed into a selected shape and having a pair of spaced, substantially planar outer layers each having an outer periphery defining an elongated, flexible fastening member extending substantially along the entire length of each of said outer layers, one of said outer layers having an inner surface operatively connected to a portion of the crown at a selected location, said carrying member being structured for storing between said outer layers a hat in said collapsed position, said fastening member being formed to have a closed position and an opened position wherein said fastening member when in said closed position joins said outer layers to store said hat in said collapsed position and when in open position enables a stored collapsed hat to be removed therefrom and expanded into an expanded position.

25. The hat assembly of claim 24 further comprising at least one attachment member operatively connect to and extendable outwardly from said carrying member for carrying said hat assembly when said hat is disposed within said carrying member and said fastening member is in its closed position.

26. The hat assembly of claim 24 wherein said brim is disposed and structured to exert a radially directed tensioning force thereon when said hat is in said expanded position.

27. The hat assembly of claim 24 wherein the carrying member and hat are formed of a breathable, soft, pliable textile material.

28. The hat assembly of claim 27 wherein said breathable, soft, pliable textile material is formed of textile material having at least 50% cotton fiber content.

29. The hat assembly of claim 27 wherein said breathable, soft, pliable textile material is formed of textile material comprising a blend of cotton fiber material and material made from man-made fibers wherein the textile material has in the order of at least 50% cotton fiber content to maintain breathability of the textile material.

30. The hat assembly of claim 29 wherein said man-made fibers are made from at least one of acrylic, polypropylene and polyester.

31. The hat assembly of claim 24 wherein said carrying member is formed of a first material and said hat is formed of a second different material.

32. The hat assembly of claim 31 wherein said first material is formed of a water resistant material and said second material is formed of a breathable, soft, pliable textile material.

33. The hat assembly of 31 wherein said first material is polyvinylchloride.

34. The hat assembly of claim 31 wherein said breathable, soft, pliable textile material is formed of textile material having at least 50% cotton fiber content.

35. The hat assembly of claim 31 wherein said breathable, soft, pliable textile material is formed of textile material comprising a blend of cotton fiber material and material made from man-made fibers wherein the textile material is in the order of at least 50% cotton fiber content to maintain breathability of the textile material.

36. The hat assembly of claim 35 wherein said man-made fibers are made from at least one of acrylic, polypropylene and polyester.

37. The hat assembly of claim 24 wherein said carrying member fastening member when in its open position includes an opening dimensioned and configured to allow passage therethrough of said hat in said collapsed position.

38. The hat assembly of claim 24 wherein said fastening member is a zipper.

39. The hat assembly of claim 24 wherein said fastening member includes a first fastening member and a cooperating second fastening member.

40. The hat assembly of claim 39 wherein said first fastening member and said second fastening member are mating elements defining a hook and loop fastener.

41. The hat assembly bag of claim 24 wherein the selected shape of the article defined by the carrying member is in the shape of a round ball.

42. The hat assembly bag of claim 24 wherein the selected shape of the article defined by the carrying member is in the shape of a basketball.

43. The hat assembly bag of claim 24 wherein the selected shape of the article defined by the carrying member is in the shape of a baseball.

44. The hat assembly bag of claim 24 wherein the selected shape of the article defined by the carrying member is in the shape of a soccer ball.

45. The hat assembly bag of claim 24 wherein the selected shape of the article defined by the carrying member is in the shape of a football.

46. The hat assembly bag of claim 24 wherein the selected shape of the article defined by the carrying member is in the shape of a car wheel and tire assembly.

47. The hat assembly of claim 24 wherein said side wall of the hat includes breathing holes.

48. A method of selectively disposing a hat in a hat assembly in either a collapsed position or an expanded position, comprising the steps of:

forming a hat comprising a head engaging portion including a side wall and a crown, a brim having a substantially annular configuration at least partially defined by a central opening and an outer periphery having a continuous, substantially circular configuration wherein said side wall have an inner end being of substantially equal dimension as a circumference of said central opening; said inner end being secured continuously to said circumference along mutual lengths thereof;

forming a carrying member having a selected shape and having a pair of spaced, substantially planar outer layers each having an outer periphery defining an elongated, flexible fastening member extending substantially along the entire length of each of said outer layers wherein one of said outer layers have an inner surface operatively connected to a portion of the crown at a selected location and said carrying member is structured for storing between said outer layers a hat in said collapsed position, said fastening member being formed to have a closed position and an opened position wherein said fastening member when in said closed position joins said outer layers to store said hat in said collapsed position and when in open position enables a stored collapsed hat to be removed therefrom and expanded into an expanded position; and at least one of folding and unfolding said hat between an expanded position wherein said expanded position of said hat is defined by said crown of said hat being oriented in a planar configuration and wherein said brim assumes a substantially planar configuration oriented substantially coplanar to said crown and wherein a portion of said crown is structured so as to be folded and located interior to said side wall and collapsed position wherein said collapsed position of said hat is defined by that portion of said crown structured to be folded interior of said side wall being positioned exterior to said side wall and oriented with said brim and head engaging portion being disposed in folded over relation to one another.

49. The method of claim 48 further comprising the step of:

attaching to the fastening member at least one attachment member extendable outwardly from said fastening member and being structured for carrying said hat assembly when said hat is disposed within said carrying member and said fastening member is in its closed position.

50. The method of claim 48 wherein the step of forming a hat further comprises forming the hat of a breathable, soft, pliable textile material.

51. The method of claim 48 wherein the step of forming a carrying member further comprises forming the carrying member of a breathable, soft, pliable textile material.

52. The method of claim 48 wherein the step of forming a carrying member further comprises forming the selected shape of the article defined by the carrying member in the shape of a round ball.

53. The method of claim 48 wherein the step of forming a carrying member further comprises forming the selected shape of the article defined by the carrying member in the shape of basketball.

54. The method of claim 48 wherein the step of forming a carrying member further comprises forming the selected shape of the article defined by the carrying member in the shape of a baseball.

55. The method of claim 48 wherein the step of forming a carrying member further comprises forming the selected shape of the article defined by the carrying member in the shape of a soccer ball.

56. The method of claim 48 wherein the step of forming a carrying member further comprises forming the selected shape of the article defined by the carrying member in the shape of football.

57. The method of claim 48 wherein the step of forming a carrying member further comprises forming the selected shape of the article defined by the carrying member in the shape of car wheel and tire assembly.

* * * * *